United States Patent [19]

Parrilla, Sr.

[11] 4,002,241

[45] Jan. 11, 1977

[54] RACK FOR SPORTING EQUIPMENT

[76] Inventor: Edward Parrilla, Sr., 9480 Ridge Blvd., Lobey B, Brooklyn, N.Y. 11209

[22] Filed: Mar. 1, 1976

[21] Appl. No.: 662,330

[52] U.S. Cl. ..... 211/88; 211/14

[51] Int. Cl.[2] ..... A47F 7/00

[58] Field of Search ..... 211/88, 13, 14, 126, 211/87, 132, 181, 189; 248/108, 110; 206/72; 108/152

[56] References Cited

UNITED STATES PATENTS

| | | | |
|---|---|---|---|
| 1,240,908 | 9/1917 | Weis et al. | 211/126 |
| 1,291,349 | 1/1919 | Ackers | 248/110 X |
| 2,584,006 | 1/1952 | Finger | 108/152 X |
| 3,341,026 | 9/1967 | Spitler | 211/88 |
| 3,437,214 | 4/1969 | Sainsbury | 108/152 X |
| 3,650,407 | 3/1972 | Benham | 211/14 |
| 3,704,675 | 12/1972 | Bellasalma | 108/152 |
| 3,842,979 | 10/1974 | Doelcher | 211/14 |
| 3,945,499 | 3/1976 | Brownson | 211/88 |

FOREIGN PATENTS OR APPLICATIONS

| | | | |
|---|---|---|---|
| 483,238 | 2/1970 | Switzerland | 211/87 |

*Primary Examiner*—Ramon S. Britts
*Assistant Examiner*—Robert W. Gibson, Jr.
*Attorney, Agent, or Firm*—Richard L. Miller

[57] ABSTRACT

A rack that is mountable upon a vertical wall, the rack being made from a plastic sheet that is vacuum-drawn to form a rigid, three dimensional back panel to a front side of which several trays are fitted, each tray likewise being similarly made of plastic; the trays serving to hold a basketball, football and several baseballs; the back panel also supporting a row of forward extending pegs on which sports uniforms and caps can be hung, and a pair of yoke-shaped fittings also secured to the rack serving to hold baseball bats.

1 Claim, 3 Drawing Figures

RACK FOR SPORTING EQUIPMENT

This invention relates generally to sporting goods accessories. More specifically it relates to storage racks.

It is generally well known to most parents having growing children who are interested in playing various sports, that their own rooms quickly become cluttered with sporting equipment that cannot be conveniently put away, such as a basketball, football, football helmet, and the like which are large so that they do not fit anywhere in a place assigned only for such articles. Accordingly, at best they can only be tossed in a closet among the shoes where they are in the way for the footwear, or under a bed. This situation is accordingly in want of an improvement.

Therefore, it is a principal object of the present invention to provide a rack that will hold in a neat manner all the sporting equipment of an individual.

Another object is to provide a rack for sporting equipment which can be hung on a wall so that it does not take up any floor space.

Other objects are to provide a rack for sporting equipment which is simple in design, inexpensive to manufacture, rugged in construction, easy to use and efficient in operation.

Further object of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
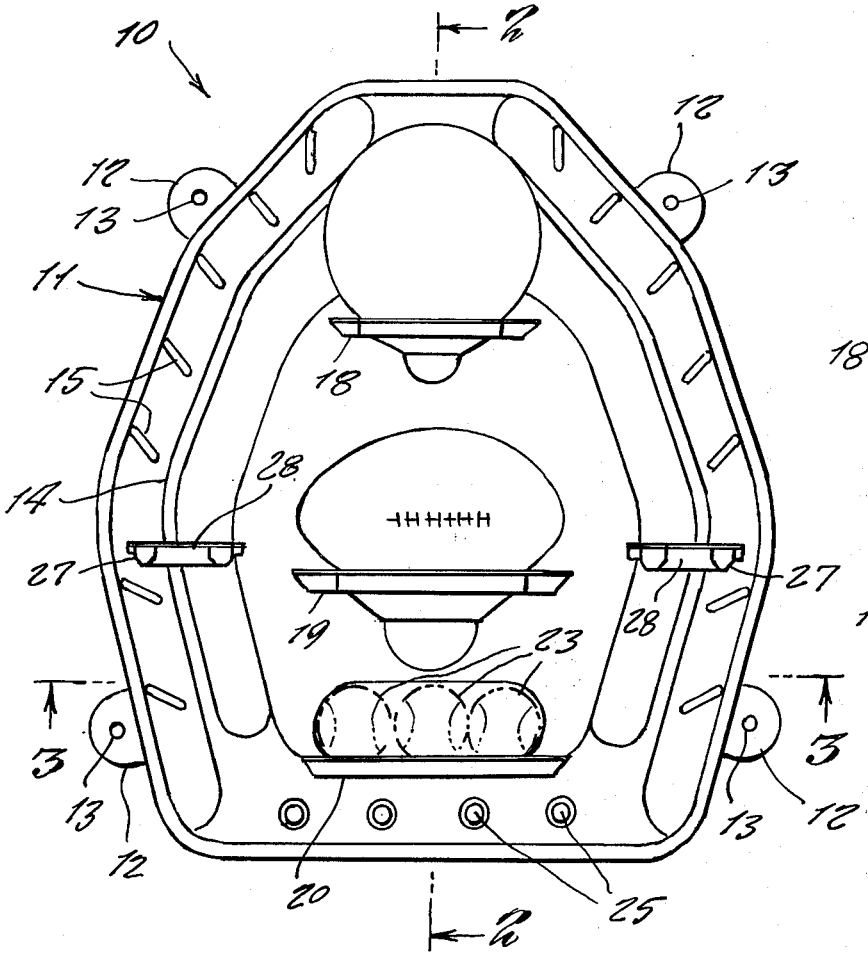
FIG. 1 is a front view of the invention.
Figure 2:
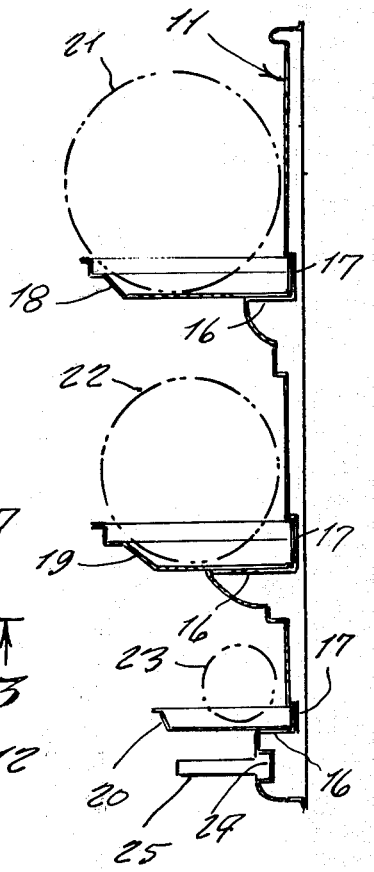
FIG. 2 is a cross sectional view taken on line 2—2 of FIG. 1.
Figure 3:
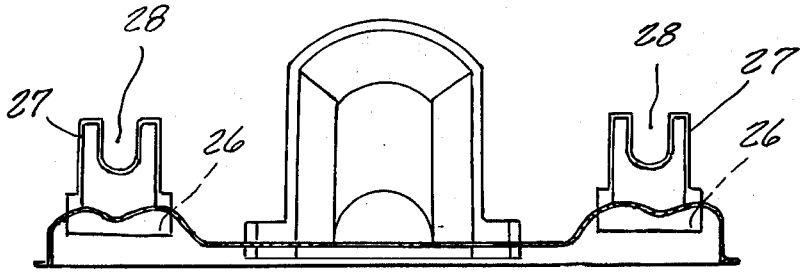
FIG. 3 is a cross sectional view taken on line 3—3 of FIG. 1.

Referring now to the drawing in detail, the reference numeral 10 represents a rack for sporting equipment, according to the present invention wherein the same includes a back panel 11 made of a rigid plastic sheet that is vacuum-drawn into a three dimensional shape so to be strong. It includes ears 12 with openings 13 therethrough for receiving mounting screws or nails for attachment to a wall of a room. Ribs 14 and ridges 15 are formed to give rigidity. Ledges 16 and recesses 17 are formed on a front side so that trays 18, 19 and 20 can be fitted there and secured by heat sealing, the trays being likewise formed of similar rigid plastic. A largest tray 18 serves to hold a basket ball 21. Tray 19 holds a football 22, and a narrowest tray 20 holds several baseballs 23.

A row of depressions 24 formed near a bottom of the back panel are each fitted with a forward extending peg 25 made of wood or other material such as solid hard plastic so that sport uniforms, caps, football helmet and the like can be hung therefrom.

Two other recesses 26 on the back panel are each fitted with a yoke shaped member 27 having notch 28 so to each support a baseball bat, golf club or the like.

It is understood that trays pegs or other fittings may be modified so that the rack is suitable for holding other type of equipment that is used in still other sports, such as hockey, Rugby, scuba diving, fishing and the like.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A rack for sporting equipment, comprising in combination, a back panel made from a plastic sheet that is vacuum-drawn into a rigid three dimensional shape, said back panel being of generally octagonal contour with a horizontal upper edge thereof being shorter than a horizontal lower edge, a set of formed ribs along each opposite side edges, an uppermost of said ribs extending vertically, a lowermost group of said ribs being slightly inclined from a horizontal plane while an intermediate group of said ribs therebetween are more greatly inclined respective to a horizontal plane, a set of sidewardly extending tabs along said opposite side edges each having an opening for receiving a mounting means to support said back panel on a vertical wall, a plurality of forwardly extending ledges formed on said panel, a set of trays formed of plastic having a rear ends thereof supported on said ledges while a rear terminal ends of said trays are fitted and heat-sealed inside shallow recesses formed on said panel thus supporting said trays on a front side of said panel, an uppermost of said trays for supporting a basketball, a lower tray for supporting several baseballs, an intermediate tray therebetween for supporting a football, a pair of forwardly extending, yoke-shaped, formed plastic fittings heat-sealed in shallow recesses formed in each sideward area of said panel for supporting a baseball bat, golf clubs or the like, and a horizontal row of recesses near a lower edge of said panel each having a rear end of a forward extending peg inserted thereinto for supporting a football helmet, cap or sports uniforms.

* * * * *